United States Patent [19]

Frontera-Mariani

[11] Patent Number: 4,779,432

[45] Date of Patent: Oct. 25, 1988

[54] LAMINATED BLOCK HOUSING FOR CHAIN LOCKING MECHANISM

[76] Inventor: Rene Frontera-Mariani, Box 652, Guanica, P.R. 00653

[21] Appl. No.: 35,323

[22] Filed: Apr. 7, 1987

[51] Int. Cl.[4] ..... E05B 67/36

[52] U.S. Cl. ..... 70/49; 70/18; 70/48

[58] Field of Search ..... 70/49, 14, 52, 259, 70/30, 18, 32–34, 31, 41–44, 15, 48

[56] References Cited

U.S. PATENT DOCUMENTS

| | | | |
|---|---|---|---|
| 1,689,437 | 10/1928 | Hurd | 70/49 |
| 1,788,396 | 1/1931 | Johnson | 70/49 |
| 1,792,403 | 2/1931 | Stone | 70/49 |
| 2,465,008 | 3/1949 | Carlson | 70/49 |
| 3,422,644 | 1/1969 | Foote | 70/52 |
| 3,797,282 | 3/1974 | Frontera-Mariani | 70/49 |
| 3,979,931 | 9/1976 | Man | 70/52 |
| 4,347,720 | 9/1982 | Kenyon | 70/18 |

FOREIGN PATENT DOCUMENTS

| | | | |
|---|---|---|---|
| 2848390 | 5/1979 | Fed. Rep. of Germany | 70/49 |
| 53-42119 | 9/1978 | Japan . | |
| 1400699 | 1/1974 | United Kingdom . | |

*Primary Examiner*—Robert L. Wolfe

*Attorney, Agent, or Firm*—Cushman, Darby & Cushman

[57] ABSTRACT

A laminated block provides a housing with the strength necessary for retaining a chain locking mechanism therein. The chain locking mechanism has opposed openings with each of the openings receiving an end link of a chain.

8 Claims, 2 Drawing Sheets

FIG. 1
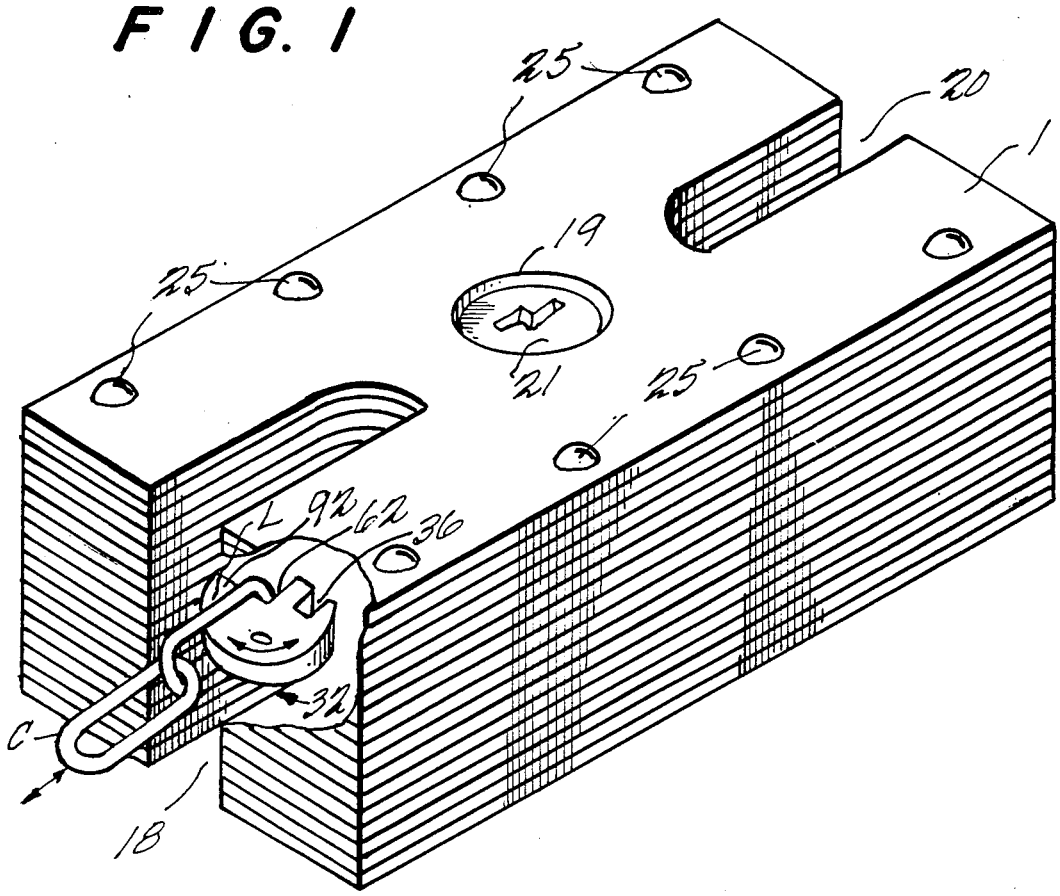
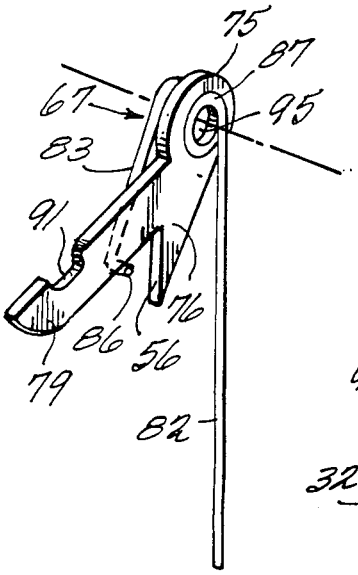
FIG. 4
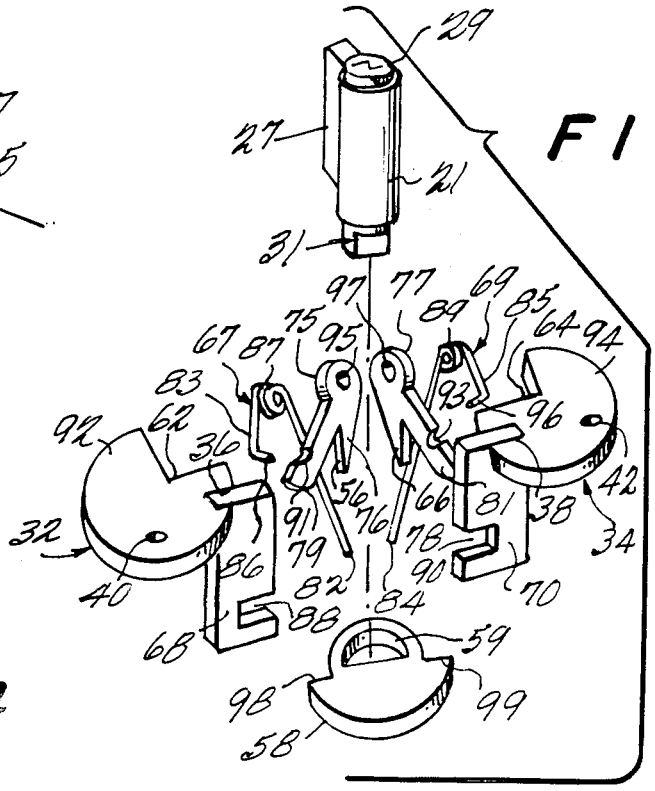
FIG. 3

LAMINATED BLOCK HOUSING FOR CHAIN LOCKING MECHANISM

BACKGROUND OF THE INVENTION

1. Field of the Invention

The present invention relates to a laminated block housing for a chain locking mechanism.

2. Description of the Related Art

The present invention is an improvement upon the inventor's own earlier U.S. Pat. No. 3,797,282, issued Mar. 19, 1974, and entitled "CHAIN LOCK".

SUMMARY OF THE INVENTION

The laminated block of the present invention contains a plurality of thin metal plates of adequate thickness with different and specific internal cutout portions. When assembled, the plates provide a housing for a chain locking mechanism, a key cylinder mechanism, a latching mechanism, and a latch-releasing mechanism. The plurality of thin plates is securely riveted together after the assembly of all parts inside the plates, thus forming a very strong steel block housing. This laminated and riveted block housing has an opening at each end for receiving a different end of a chain.

The locking mechanism of the present invention differs from the chain lock of the inventor's prior art device in that the positioning of latches and springs for urging the latches to secure the chain locking members together is changed so that the security of their functioning is improved.

BRIEF DESCRIPTION OF THE DRAWINGS

FIG. 1 shows a perspective view of the assembled steel block housing of the present invention.

FIG. 3 shows an exploded view of the latching and latch-releasing mechanisms and their relationship to the distal end of the key cylinder mechanism.

FIG. 4 shows a perspective view of a member and a coiled spring for urging the member into a functioning position.

DETAILED DESCRIPTION OF THE PREFERRED EMBODIMENT

Figure 2:
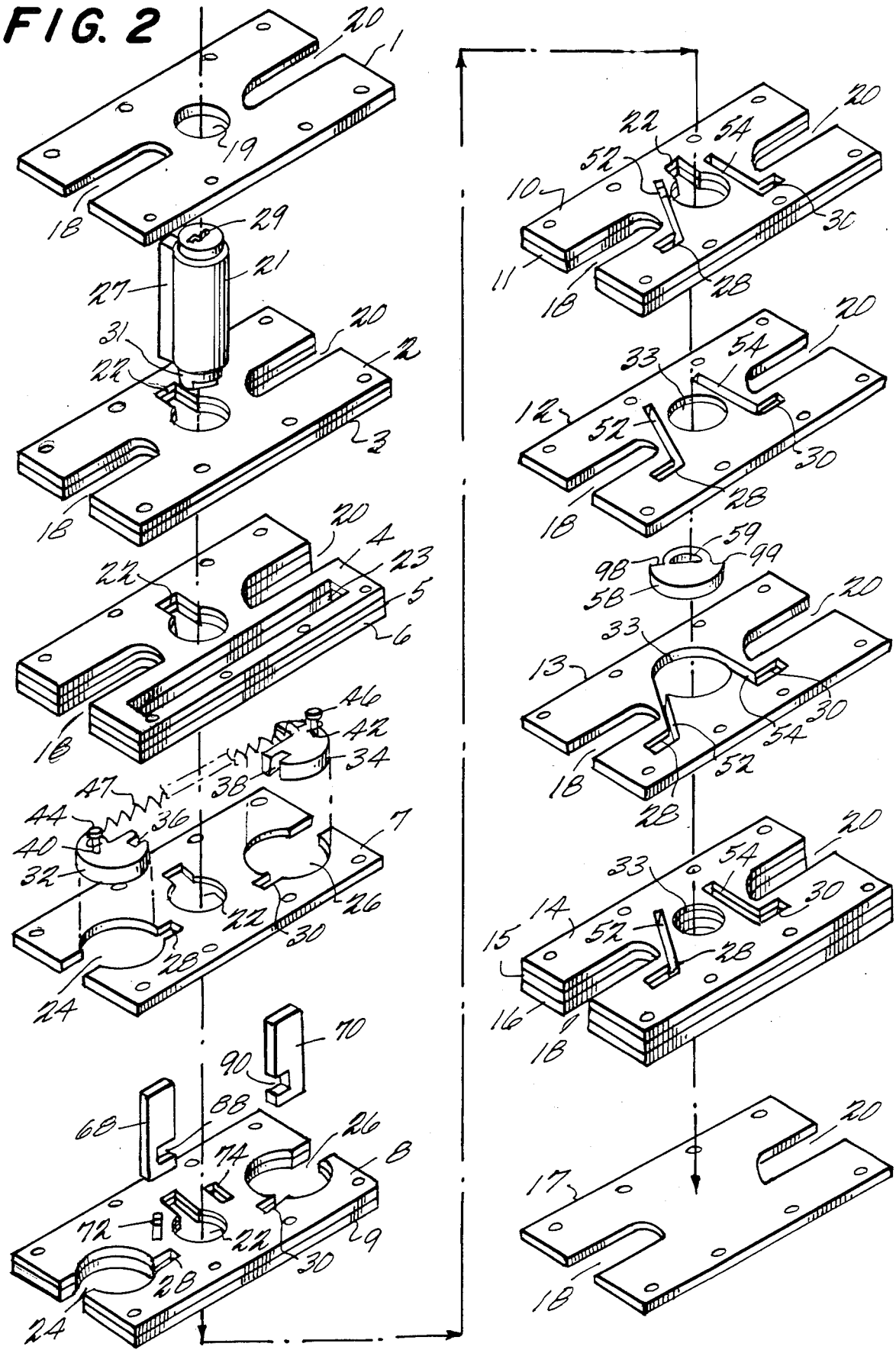
FIG. 2 shows an exploded view of the housing of FIG. 1 illustrating the components which, when assembled, comprise the chain locking mechanism, the key cylinder mechanism, the latching mechanism, and the latch-releasing mechanism.

FIG. 1 illustrates a perspective view of a laminated block which houses a chain locking mechanism, a key cylinder mechanism, a latching mechanism, and a latch-releasing mechanism. This laminated block is formed by seventeen (17) plates made of metal, preferably steel. The plates, when assembled with the above-mentioned mechanisms, are secured together by rivets (not shown) which pass through holes 25 bored through each of the plates while held in alignment.

The block has openings 18 and 20 at opposite ends for receiving end links L of a chain C so that the block can hold both end links L of the chain C together. For example, an end link L of the chain C is fed manually into the opening 18 and is locked therein by chain engaging portions 62 and 92 of chain locking member 32. In the opening 20, there is a mirror-image chain locking member 34 with chain engaging portions 64 and 94 shown in FIG. 3.

In FIG. 2, each of the plurality of plates 1-17 is shown in an exploded view. In top plate 1, there are side openings 18 and 20 and a central bore 19. A key cylinder mechanism 21 is mounted so that a longitudinal side bar 27 fits into a plurality of keyhole-shaped housing holes 22 cut into plates 2 through 11. This key cylinder mechanism 21 is retained in the laminated block housing because the top of the side bar 27 is prevented from slipping out of the central bore 19 in the top plate 1 due to the differences in the shapes of the round bore 19 in the plate 1 and the keyhole-shaped cylinder mechanism 21. This key cylinder mechanism 21 has a keyhole 29 for receiving a key (not shown) which operates to unlock the end link L of the chain C from the openings 18 and 20 in the block. A slug 31 at a lower end of the key cylinder mechanism 21 is housed in central bores 33 in plates 12 through 16. The key cylinder mechanism 21 is prevented from slipping out of the bottom of the block because a bottom plate 17 has no central bore therein through which the key cylinder mechanism 21 might otherwise escape.

In plates 4 through 6, there is cut a longitudinal slot 23 which provides space for posts 44 and 46 to extend a spring 47 therein. The posts 44 and 46 are implanted in bores 40 and 42, respectively, which are drilled into chain locking members 32 and 34, respectively. The height of the posts 44 ad 46 is less than the thickness of the plates 4 through 6 because there has to be a tolerance gap between the heads of the posts 44 and 46 and the plate 3 over them in order to avoid contact and friction therewith, thus allowing for free rotation of the chain locking members 32 and 34 thereunder. The chain locking members 32 and 34 are continually urged by the spring 47 to rotate so that the posts 44 and 46 are as close as possible to each other. The thickness of the chain locking members 32 and 34 is slightly less than the sum of the thicknesses of plates 7 through 9 so as to provide tolerance for the rotation of such chain locking members 32 and 34 between plate 6 overhead and plate 10 underneath. The single set of chain locking members 32 and 34 is housed in holes 24 and 26, respectively, cut through plates 7, 8 and 9. The chain locking members 32 and 34 have notches 36 and 38, respectively, which engage latches 68 and 70, respectively. The latches 68 and 70 are a pair of vertically oriented rectangular metal bars. Slits 28 and 30 which extend from holes 24 and 26, respectively, in plates 7 through 9, form part of channels for the latches 68 and 70, respectively, to move vertically. These slits 28 and 30 are also cut in plates 10 through 16 and form the rest of the channels in which the latches 68 and 70 slide up and down to lock or release the chain locking members 32 and 34 that are activated by the key cylinder mechanism 21. The plates 7 through 9, when assembled together, form a housing for the chain locking members 32 and 34 so that they may rotate in holes 24 and 26, respectively, as turned by the posts 44 and 46. As shown in FIG. 2, slits 72 and 74 in the plates 8 and 9 hold in position the heads 75 and 77 (see FIG. 3) of members 76 and 78, respectively. As also shown in FIG. 2, slots 52 and 54 are cut in plates 10 through 16 and join the slits 28 and 30, respectively, at one end. These slots 52 and 54 are wide enough to house members 76 and 78, each being already assembled with respective springs 67 and 69 (see FIGS. 3 and 4).

The slots 52 and 54 form channels in which springs 67 and 69 (see FIG. 3) move when the key cylinder mechanism 21 actuates them making the latches 68 and 70 either lock or release the chain locking members 32 and 34. As shown further in FIG. 3, notches 88 and 90 in latches 68 and 70 engage legs 79 and 81 of members 76 and 78, respectively. It is also shown that member 58 engages at its tips 98 and 99 the pointed parts 56 and 66 of members 76 and 78, respectively, while member 58 rotates in the central bore 33 that is enlarged only in plate 13. The member 58, as shown above the plate 13, has a first semicircular section with a first radius and a second semicircular section with a second radius. The member 58 has a semicircular hole 59 therethrough in the second semicircular section. Note that the radius of the second semicircular section is shorter than the radius of the first semicircular section. The hole 59 in the second semicircular section retains therein the slug 31 at the lower end of the key cylinder mechanism 21. Member 58 also has two pointed tips 98 and 99.

Referring now to FIG. 3, there is more clearly shown, in the exploded perspective view thereof, the spatial relationship between the various moving elements that are housed among the plates 1-16 making up the block without such plates 1-16 being shown. Chain-engaging portions 92 and 94 of members 32 and 34, respectively, are clearly visible. Central coiled parts 87 and 89 of springs 67 and 69, respectively, are wound inside eyelets or holes 95 and 97 through the heads 75 and 77 of the members 76 and 78, respectively. The engagement of one spring 67 with its corresponding member 76 is illustrated in FIG. 4. The springs 67 and 69 have long arms 82 and 84, respectively, at one end and short arms 83 and 85 with tips 86 and 96, respectively, at an opposite end. The long arms 82 and 84 project out from the coiled parts 87 and 89 of the springs 67 and 69, respectively, at an angle of about 90° to the short arms 83 and 85 of the springs 67 and 69, respectively. Likewise, the tips 86 and 96 extend at 90° angles from the short arms 83 and 85, respectively, of the springs 67 and 69. These tips 86 and 96 are bent under the legs 79 and 81, respectively, of the members 76 and 78. Such members 76 and 78 also have pointed parts 56 and 66, respectively, descending from their eyelets in the heads 75 and 77. Notches 91 and 93 are cut into upper portions of the legs 79 and 81, respectively, of the members 76 and 78 and engage with the notches 88 and 90 in the latches 68 and 70, respectively. The long arms 82 and 84 of the springs 67 and 69 are held in fixed positions in the slots 52 and 54, respectively, cut into plates 10 through 16 (see FIG. 2), adjacent to the slits 28 and 30 in which the latches 68 and 70 slide up and down.

In reference to FIG. 3, the operation of the present invention will be described. When a key (not shown) is inserted in the keyhole 29 of the key cylinder mechanism 21, the slug 31 at the lower end thereof is rotated. Because the slug 31 is fitted into the semicircular hole 59 of the member 58, such member 58 is also rotated so that either one of its two pointed tips 98 and 99 shift either into or out of contact with the pointed parts 56 and 66 of the members 76 and 78, respectively, depending upon whether the key is turned in one direction or the other. Taking FIG. 4 as an example, it can be seen that, if the pointed part 56 is pushed by the pointed tip 98 and rotated counterclockwise, the leg 79 of the member 76 will move downwardly (counterclockwise), urging the tip 86 of the arm 83 of the spring 67 down and compressing the spring 67. During this motion, leg 79 of member 76, which is engaged to notch 88 of the latch 68, will push this latch 68 down and out of the notch 36 in chain locking member 32. Because the latch 68 no longer retains member 32 in position, the member 32 is rotated in the hole 24 (FIG. 2) of plates 7 through 9 by the spring 47 which pulls the post 44 implanted in the hole 40 in member 32 towards the post 46 implanted in the hole 42 in member 34. Now the latch 68 is out of member 32 and spring 67 is compressed, urging the leg 79 of member 76 up, thus pushing latch 68 upwards against the side of chain locking member 32 which rotated previously and therefore its notch 36 is no longer aligned with latch 68. The notch 91 in leg 79 of member 76 will provide space enough so as to prevent friction and/or the locking of leg 79 of member 76 with the edges of notch 88 of the latch 68 when the leg 79 of member 76 is actuated and moves, thus changing its angle of approach to the latch 68. Leg 79 of member 76 is never out of notch 88, so it never becomes disengaged from latch 68. Usually, the notch 91 in leg 79 of the member 76 is engaged in the slot 88 of the latch 68. See FIG. 3. However, the counterclockwise rotation of the leg 79 causes the notch 91 to slip out of the notch 88 of the latch 68 and, thus, to disengage from the latch 68. Because the latch 68 no longer retains the member 36 in position, the member 32 is rotated in the hole 24 (FIG. 2) of plates 7 through 9 by the spring 47 which pulls the post 44 implanted in the hole 40 in member 32 towards the post 46 implanted in the hole 42 in member 34. As member 32 is rotated counterclockwise, the chain engaging portion 92 (FIG. 3) is rotated out of the opening 18 and into the interior of the block. Thus, as may be surmized from FIG. 1, the end link L of the chain C is free to be removed from the opening 18 in the block. The above discussion described the disengagement of the chain C from the block of the present invention.

The engagement of the chain C with the block will now be described. As shown in FIG. 1, an end link L of the chain C is fed manually into the opening 18 until contact is made with the chain engaging portion 62 of the chain locking member 32. As the link L is forced inwardly against the portion 62, the member 32 rotates clockwise until its other chain engaging portion 92 enters the opening 18 from the left and closes behind link L. As the member 32 rotates in plates 7 through 9, (see FIG. 2) the notch 36 in the member 32 aligns with the slit 28 in the plates 7 through 9. When latch 68 is out of member 32, the compressed spring 67 then pushes and urges the latch 68 upwards by urging the member 76 to rotate now in the opposite direction (clockwise). In its position, the latch 68 is pressed against the side of chain locking member 32 permanently. When the chain end is introduced into the opening 18 and is manually pushing portion 62 of member 32, this member 32 rotates (clockwise) until notch 36 of member 32 becomes aligned with latch 68. At this precise moment, the already compressed spring 67 will push and urge automatically latch 68 into notch 36 of member 32, locking it permanently until released by the action of a key. This key, therefore, will be used and is necessary only to release a chain end which previously was inserted into the block 1 and was locked automatically inside as it reached the necessary depth in the openings 18 or 20 of the block 1. Thus, as shown in FIG. 1, the end link L of the chain C will be locked into the opening 18 until unlocked again by the operator's key.

The foregoing preferred embodiment is considered illustrative only. Numerous other modifications will readily occur to those persons skilled in the pertinent art after reading this disclosure. Thus, the disclosed invention is not limited to the exact construction and operation shown above but is encompassed within the appended claims.

I claim:

1. A chain lock comprising:

a laminated block housing formed from a plurality of thin metal plates, each having different and specific cutout portions so that when the plates are assembled, a metal housing is defined having a pair of openings, one at each end thereof, for receiving a chain end and having an internal housing for a chain locking mechanism, said chain locking mechanism including:

a pair of chain engaging members rotatably mounted within the laminated block housing, each of said pair of chain engaging members having portions for receiving a chain end fed into a respective one of the pair of openings;

a first spring means, connected between the pair of chain engaging members, for urging rotation of the chain engaging membes to a chain releasing position;

latching means, mounted within the laminated block housing, a pair of latches for retaining the pair of chain engaging members in a chain locking position against the force applied by the first spring means;

second spring means, mounted within the laminated block housing for urging a pair of members, each having an eyelet and a leg, the leg of each said member in turn engaging and urging the latching means into engagement with the chain engaging members;

a platelike member rotatably mounted within the laminated block housing, said platelike member urging said member with said eyelet so as to urge the leg of said member with said eyelet in opposition to said second spring means to move said latching means out of engagement with said chain locking members; and key means, retained within the laminated block housing for rotating at one end the platelike member in and out of engagement with said member with said eyelet;

whereby one chain end is secured by one chain engaging member in the respective one of the pair of openings in the laminated block housing.

2. The chain lock as recited in claim 1 wherein:

said latching means includes a pair of vertically oriented rectangular metal bars with a notch cut out from one side of each of the bars.

3. The chain lock as recited in claim 1 wherein:

said second spring means includes a pair of springs having each a central coiled portion, a relatively long arm at one end, and a relatively short arm at an opposite end with a tip bent at 90° to the short arm.

4. The chain lock as recited in claim 3 wherein:

said second spring means further includes a pair of members each having an eyelet at one end, a leg with a notch therein at an opposite end, and a portion with a pointed part descending from the eyelet.

5. The chain lock as recited in claim 4 wherein:

said eyelet of the member receives the central coiled portion of the spring and said notch in the leg of the member engages with the latching means.

6. The chain lock as recited in claim 1 wherein:

said platelike member has a first semicircular section with a first radius and a second semicircular section with a second radius, said second radius being shorter than said first radius.

7. The chain lock as recited in claim 6 wherein:

said second semicircular section of the platelike member has a semicircular hole therethrough for receiving the one end of the key means.

8. The chain lock as recited in claim 1 wherein:

said key means includes a cylindrical portion and a longitudinal side bar means, secured to the cylindrical portion, for retaining the key means in the laminated block housing.

* * * * *